United States Patent [19]

Beardmore

[11] Patent Number: 4,504,211

[45] Date of Patent: Mar. 12, 1985

[54] COMBINATION OF FUELS

[75] Inventor: David H. Beardmore, Bartlesville, Okla.

[73] Assignee: Phillips Petroleum Company, Bartlesville, Okla.

[21] Appl. No.: 403,983

[22] Filed: Aug. 2, 1982

[51] Int. Cl.[3] ..... F23J 7/00

[52] U.S. Cl. ..... 431/3; 431/10; 431/352; 60/39.02; 60/732

[58] Field of Search ..... 431/3, 4, 10, 351, 352; 60/39.02, 732, 733

[56] References Cited

U.S. PATENT DOCUMENTS

| | | | |
|---|---|---|---|
| 1,910,735 | 5/1933 | Zikesch | 110/104 R |
| 2,398,654 | 4/1946 | Lubbock et al. | 431/352 |
| 2,958,194 | 11/1960 | Bayley | 431/352 |
| 3,746,498 | 7/1973 | Stengel | 431/10 |
| 3,850,569 | 11/1974 | Alquist | 60/39.05 |
| 4,113,425 | 9/1978 | Von Linde et al. | 60/732 |
| 4,235,585 | 11/1980 | Anderson | 431/4 |
| 4,382,771 | 5/1983 | Carr | 60/39.55 |
| 4,395,223 | 7/1983 | Okigami et al. | 431/175 |

*Primary Examiner*—Carroll B. Dority, Jr.

[57] ABSTRACT

$NO_x$ emissions are reduced in the combustion of fuels by carrying out the combustion in at least four serially connected combustion zones, including at least three fuel-rich zones followed by a fuel-lean zone. In accordance with another aspect of the present invention, $SO_x$ emissions are reduced in the burning of a normally solid fuel, containing significant amounts of $SO_x$ precursors, by adding a sulfur scavenger to the fuel and thereafter burning the fuel in at least four serially connected combustion zones, including at least three fuel-rich zones followed by a last fuel-lean zone, and carrying out the combustion of the fuel in at least four combustion zones.

11 Claims, 8 Drawing Figures

COMBINATION OF FUELS

The present invention relates to the combustion of fuels. In a more specific aspect, the present invention relates to the combustion of fuels, containing significant amounts of $NO_x$ and/or precursors, to significantly reduce the volume of $NO_x$ and/or $SO_x$ pollutants.

BACKGROUND OF THE INVENTION

Nitrogen oxides, primarily NO and $NO_2$ are one of the major classes of air pollutants which are created during combustion processes. It is known that a two-stage, rich-lean combustion process will reduce $NO_x$ pollutants when fuels containing bound or fuel nitrogen ($NO_x$ precursors) are burned. In this process, the first stage is fuel-rich and in this stage, $NO_x$ pollutants normally formed from fuel nitrogen and atmospheric nitrogen are reduced to $N_2$. Thereafter, the remainder of the air needed for completion of the combustion of unburned and partially burned fuel is added and the combustion is completed. The fuel-rich equivalence ratio (the ratio of actual fuel to actual air over the ratio of fuel-to-air necessary for stoichiometric combustion or $\Phi$) is optimum between about 1.0–1.7 in order to obtain minimum $NO_x$ pollutants. The second volume of air is then added to the effluent from the fuel-rich stage to produce an overall equivalence ratio less than 1.0, usually about 3 to 15% excess oxygen. While such two-stage, rich-lean combustion substantially reduces the $NO_x$ pollutant emissions from the burning of solid fuels, the amounts of $NO_x$ pollutants are still comparatively high, particularly with solid fuels. It has also been suggested that further $NO_x$ reductions can be attained by operating a staged combustor with two fuel-rich stages followed by the fuel-lean stage, thus operating in a three-stage mode. While further reductions in $NO_x$ pollutant production are attained in this fashion, the $NO_x$ emissions are still comparatively high. Obviously, once an initial substantial reduction in $NO_x$ pollutants is attained by any form of $NO_x$ reduction, it is most difficult and in many cases, impossible, to obtain the last increments of reduction necessary to meet pollution control standards or provide a margin of safety between attainable results and pollution control standards.

Unfortunately, many fuels, particularly normally solid fuels, such as coal, lignite, etc., also contain substantial amounts of bound or fuel sulfur and the result is that conventional combustion produces substantial amounts of $SO_x$ pollutants which are also subject to pollution control. It has generally been the opinion of workers in the art that those conditions employed in staged combustion, particularly two-stage, rich-lean combustion, for $NO_x$ reduction will likewise lower the level of $SO_x$ emissions. However, it has been found in parallel work that little or no reduction in $SO_x$ emissions can be attained in a two-stage, rich-lean combustion process. As a matter of fact, it has been found that the presence of substantial amounts of sulfur in a fuel also has a detrimental effect on $NO_x$ reduction in a two-stage, rich-lean process.

A substantial amount of work has been carried out in the removal of sulfur from normally solid fuels, such as coal, lignite, etc. Such processes include wet scrubbing of stack gases from coal fired burners. However, such systems are capital intensive and often unreliable. In addition, the disposal of wet sulfite sludge, which is produced as a result of such scrubbing techniques, is also a problem. Finally, the flue gases must be reheated after scrubbing in order to send them up the stack, thus reducing the efficiency of the system.

In accordance with other techniques, sulfur scavengers are utilized, usually in fluidized bed burners, to act as scavangers for the sulfur and convert the same to solid compounds which are removed with the ash. The usual scavengers in this type of operation include; limestone (calcium carbonate) and dolomite (magnesium-calcium carbonate) because of availability and cost. However, the burning techniques are complex and expensive to operate and control and the burner equipment is comparatively expensive.

SUMMARY OF THE INVENTION

It is, therefore, an object of the present invention to provide an improved process for the burning of fuels which overcomes the above-mentioned and other problems of the prior art. Another object of the present invention is to provide an improved process for burning fuels in which $NO_x$ emissions are reduced. Another and further object of the present invention is to provide an improved process for burning fuels in which $SO_x$ emissions are reduced. Yet another object of the present invention is to provide an improved process for the burning of fuels in which both $NO_x$ and $SO_x$ emissions are reduced. These and other objects of the present invention will be apparent from the following description.

In accordance with the present invention, fuels are burned in a staged combustion process comprising at least three fuel-rich stages followed by a fuel-lean stage. In accordance with another aspect of the present invention, $SO_x$ emissions are reduced in the burning of fuels by adding a sulfur scavenger, preferably calcium compound, such as limestone, dolomite, etc. to a fuel and thereafter burning the fuel in a staged combustion comprising at least three fuel-rich stages followed by a fuel-lean stage.

DESCRIPTION OF THE PREFERRED EMBODIMENTS

The present invention basically involves burning a fuel, containing significant amounts of $NO_x$ precursors, in a combustor having at least four, serially connected combustion zones, including at least three fuel-rich zones and a last fuel-zone, and such a process carried out in at least four stages in the presence of a sulfur scavenger.

All of the fuel is mixed with a first volume of combustion-supporting material adjacent the upstream end of the first of the fuel-rich zones. Fuels which can be burned in accordance with the present invention include normally gaseous fuels, such as natural gas, normally liquid fuels, such as petroleum derived fuels, shale oils, coal liquids, etc., as well as normally solid carbonaceous materials, such as coal, lignite, etc. The advantages of the present application are pointed out hereinafter in the burning of normally solid fuels, since the reduction of $NO_x$ pollutants in burning such normally solid fuels is most difficult and the results obtained are generally at least as good when burning of other fuels. Suitable combustion-supporting materials include any material which will support combustion, including oxygen, oxygen-enriched air, air, etc.

Figure 2:
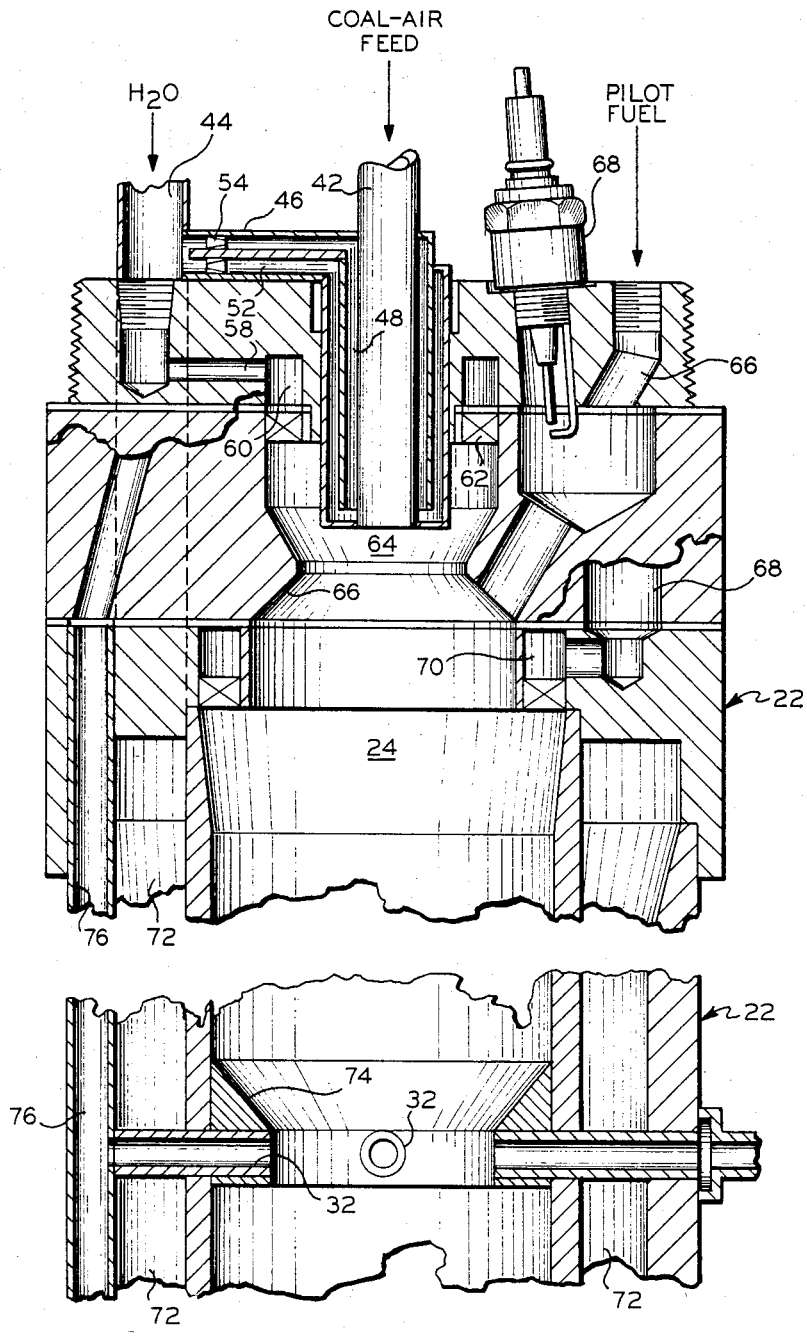
FIG. 2 shows, in greater detail, a suitable upstream end for a combustor burning solid fuels, as in FIG. 1 and a means for abruptly terminating a preceding an upstream stage of combustion and initiating the next stage of combustion.

One critical factor in carrying out the present invention is the obtention of an intimate mixture of the fuel and the combustion-supporting material. Suitable methods and apparatus have been developed for intimately mixing fuel and combustion supporting materials. FIG. 2 of the drawings illustrates a means for mixing a normally solid carbonaceous material and air adjacent the upstream end of the first fuel-rich zone and mixing additional air adjacent the upstream ends of the remaining combustion zones.

Additional volumes of combustion-supporting material are added to the upstream end of each of the remaining fuel-rich zones and mixed with the effluent from the immediately preceeding fuel-rich zones. The total combustion supporting material thus added adjacent the upstream end of all of the fuel-rich zones, including the first, forms, with the fuel, a fuel-combustion supporting material equivalence ratio, which is fuel-rich or greater than 1.0.

Finally, yet another volume of combustion-supporting material is added adjacent the upstream end of the last or fuel-lean combustion zone and mixed with the effluent from the last of the fuel-rich zones. The total combustion supporting material thus added adjacent the upstream end of all of the fuel-rich zones plus that added at the upstream end of the fuel-lean zone forms, with the fuel, a fuel-combustion supporting material equivalence ratio less than 1.0.

Another significant factor in operating, in accordance with the present invention, provides clearly defined combustion zones, preferably where the combustion in a combustion zone is abruptly terminated and combustion in the next succeeding zone is initiated. This can be accomplished, to some extent, by the manner in which the combustion supporting material is introduced adjacent the downstream end of each combustion zone. Specifically, if the combustion supporting material is introduced as a plurality of radial jets toward the center of the combustor, good mixing can be attained and abrupt termination of one zone and initiation in the following zone initiated. However, even better termination of combustion in one zone and initiation of combustion in the following zone can be obtained if the air is introduced as radial jets and the flame front or effluent from one zone is then expanded abruptly into the succeeding zone. In this case, the air or combustion supporting material is preferably injected as radial jets immediately preceding the abrupt expansion. This technique not only improves mixing but also, to a certain extent, prevents back flow of combustion supporting material into the first-mentioned zone with the resultant dilution and unstabilizing effects which such back flow will produce. However, substantially better termination of each combustion zone and initiation of combustion in the following combustion zone can be obtained by reducing the peripheral dimension of the effluent or flame front at the downstream end of a given combustion zone and thereafter abruptly expanding the effluent or flame front into the next succeeding zone, while injecting the combustion-supporting material as a plurality of radial jets immediately adjacent the point of reduction and expansion. In a preferred technique, the reduction in peripheral dimensions can be obtained by an annular baffle or baffles, or still more preferably by a nozzle means. In this case, the combustion supporting material is preferably injected as a plurality of radial jets in the vena contracta or reduced dimension portion of the effluent or flame front. This technique is illustrated in FIG. 2 of the drawings.

It has also been discovered that, where a fuel, particularly normally solid carbonaceous materials, such as coals, lignites, etc., is burned, the production of $SO_x$ emissions can be substantially reduced by carrying out combustion in at least four serially connected combustion zones, as previously described, and adding at the upstream end of the first fuel-rich zone a sulfur scavenger.

As pointed out in the introductory portion hereof, such sulfur scavengers are known in the art and have been utilized, to a great extent, in work dealing with the combustion of normally solid fuels in fluidized bed combustors. Such sulfur scavengers include calcium compounds, such as calcium carbonate (limestone), calcium hydroxide, calcium, magnesium carbonate (dolomite) as well as other metal carbonates, such as magnesium carbonate (magnesite), etc. The most usual sulfur scavengers are limestone and dolomite, because of availability and relative cost. In any event, the sulfur scavengers will generally form a metal sulfate which can be removed from the flue gas of the process, for example, where limestone is utilized in the burning of normally solid carbonaceous fuels, calcium sulfate is formed, which is a solid and thus can be collected with the ash from the combustion process. Obviously, the amount of sulfur scavenger employed should be near the metal/-sulfur stoichiometric ratio.

Consequently, by operating in accordance with this latter technique, both $NO_x$ and $SO_x$ pollutants can be removed in the burning of fuels containing both $NO_x$ and $SO_x$ precursors.

The present invention will be further apparent from the following description when read in conjunction with the drawings.

Figure 1:
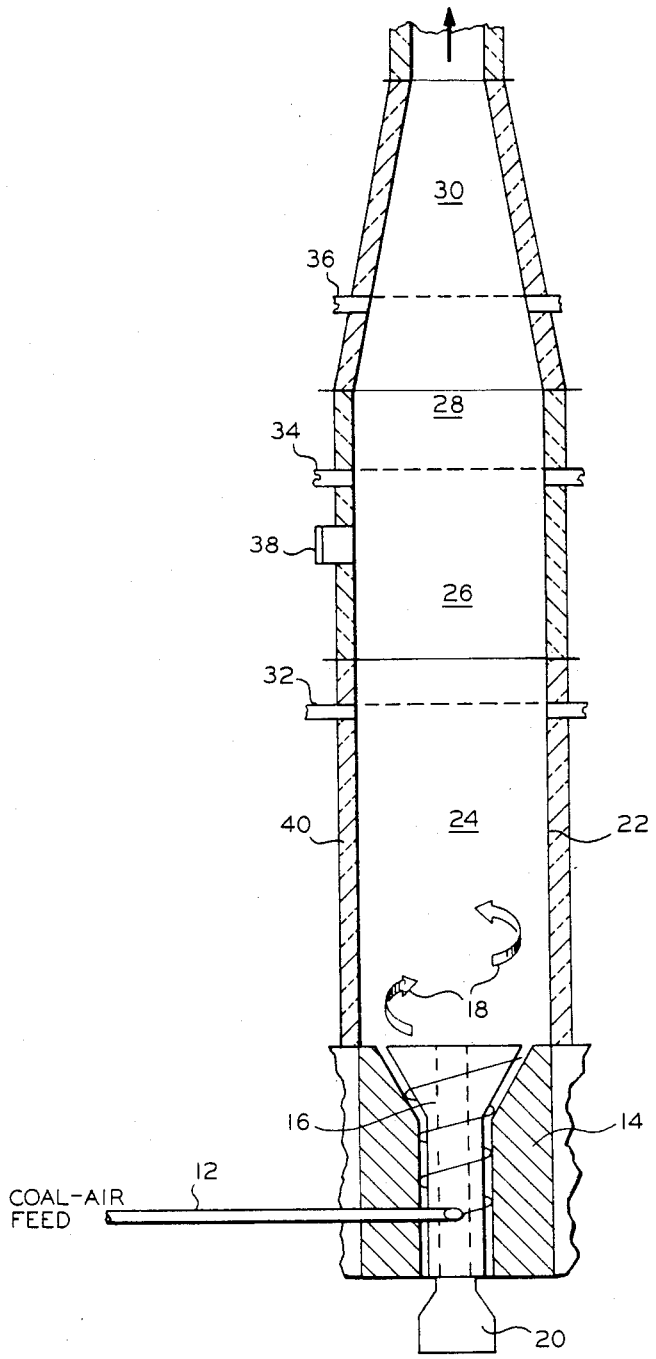
FIG. 1 of the drawings is a schematic illustration of a staged combustor suitable for use in accordance with the present invention.

FIG. 1 of the drawings is a schematic illustration of a burner, which can be utilized in accordance with the present invention, and, specifically a four-stage burner adapted to operate with three fuel-rich stages followed by a fuel-lean stage. In accordance with FIG. 1, a feed line 12 introduces pulverized coal and air to an annular space formed by a housing 14 and an inner core 16. The coal-air feed enters the burner as a spiral or rotating stream as shown by the spiral line 18. A propane torch or pilot 20 passes through the center of the core for lighting the burner. The rotating stream of coal and air pass into the burner body 22. Burner body 22 comprises three fuel-rich stages 24, 26 and 28, respectively, followed by a fuel-lean stage 30. Additional air is introduced through radial ports 32 to the fuel-rich second stage 26, through ports 34 to the fuel-rich third stage 28 and through the ports 36 to the fuel-lean fourth stage 30. Sight glass 38 is provided to observe the flame in the burner body 22. A blanket of insulation 40 is formed around the outside of burner body 22. The burner can also be operated as a single stage, two-stage or three-stage burner by closing selected air ports.

FIG. 2 of the drawings illustrates in greater detail an arrangement for the upstream end or feed end of a burner, such as that of FIG. 1, utilizable in accordance with the present invention and means for feeding air and abruptly terminating the first fuel-rich section 24 or any of the remaining combustion zones of the burner of FIG. 1. Duplicate numbers corresponding to those utilized in FIG. 1 have been utilized in FIG. 2, where possible.

In accordance with FIG. 2, coal and the first portion of air are fed to the burner through line 42, which is simply a straight, open-ended pipe. In some cases, there is a tendency for fuel to become sticky and agglomerate in feed line 42. Accordingly, this feed line 42 is preferably cooled, for example, by water, introduced through line 44, thence circulated through channel 46, annular passage 48, annular passage 50, thence through channel 52 and back to water line 44. If necessary appropriate one-way check valves 54 and 56 are provided in water channels 46 and 52, respectively. A second position of air enters through a plurality of tangential ports 58 which introduce the air in a swirling manner into annular plennum 60. The means of swirling the air may also be an annular ring, represented schematically as 62, having blades at an appropriate angle to cause the air to enter in a swirling manner. The feed and air introduced through line 42 and the swirling air introduced through ports 58 then begin mixing in the mixing chamber 62. Mixing chamber 62 is provided with a necked-down portion 64 which aids in the mixing of the fuel and air. The propane torch lighter 20, FIG. 1, includes a propane introduction line 66 and a spark plug or electrical igniting means 68. The pilot flame then passes into mixing chamber 62. Downstream from necked-down portion 64 is an air line 68 which feeds air tangentially into annular plennum 70 to thereby introduce the air in a swirling manner. Preferably, the air from plennum chamber 60 and that from plennum chamber 70 rotate in opposite directions. The cooling water passes through annular channel 72 to cool the burner. As previously indicated in connection with FIG. 1, this space may be filled with insulation or cooled in some other manner. The mixture of fuel and the three portions of air then enter the first fuel-rich combustion zone 24 and constitute the first volume of air to the upstream end of the first fuel-rich combustion zone.

Another significant feature of a burner suitable for use in accordance with the present invention is the means for terminating each combustion zone and abruptly changing from one equivalence ratio to the next equivalence ratio. Specifically, a nozzle 74, which forms a necked-down portion to reduce the diameter of the flame front and then abruptly expand the same, is provided at the downstream end of each combustion zone. The air, for example, introduced through ports 32 (FIG. 1) is then introduced as a plurality of radial jets in the vena contracta of nozzle 74. This arrangement serves a number of functions, but basically provides a technique for abruptly terminating combustion in one zone and initiating combustion in the next successive zone. The manner of introducing the air and the contraction and expansion of the flame front aids in the mixing of the air introduced through ports 32 with the flame front at the downstream end of combustion zone 24 and also prevents back flow of air introduced through ports 32 into combustion zone 24. Obviously, also, initiation of combustion at the next lower equivalence ratio in combustion zone 26 is also initiated abruptly and thereby more effective combustion is attained while maintaining the integrity of each combustion zone. A channel 76 may also be provided for inserting a thermocouple to measure temperature at any particular desired point or points along the length of the combustor.

The burner schematically illustrated in FIG. 1 was utilized to carry out a series of comparative tests in accordance with the present invention. In this series of tests, coal was ground to a fineness such that 70–80% thereof passed a 200 mesh screen. The coal was fed to the burner at a rate of about five pounds per hour and at a velocity of fifty feet per second. The fuel-air equivalence ratio for all fuel-rich stages was varied over a range from about 0.85 (stiochiometric ratio) up to about 1.75 and it was found generally that an equivalence ratio between about 1.4 and 1.75 was optimum.

Figure 3:
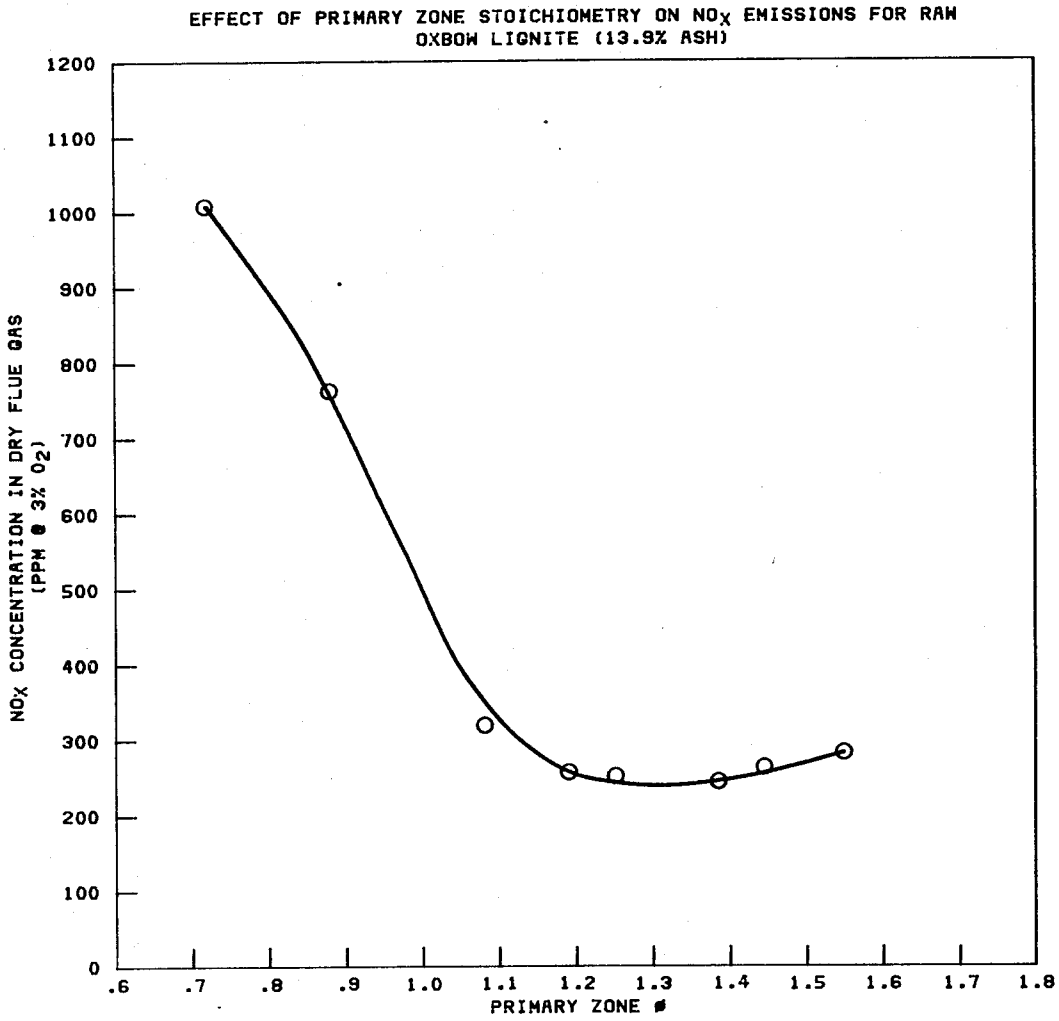
FIG. 3 is a plot of $NO_x$ concentration in flue gas versus fuel-rich zone equivalence ratio for a two-stage rich-lean combustion.

The results of a test, in which $NO_x$ concentration in flue gas was measured at various fuel-rich equivalence ratios in a two-stage burner when burning a raw lignite containing about 13.9% ash, are shown in FIG. 3, which illustrates $NO_x$ reduction attainable in a two-stage, rich-lean combustion process.

Another series of runs were conducted using the same lignite with a combustion catalyst added and in a three-stage combustor having two fuel-rich stages, namely, ports 34 and 36 of FIG. 1 with a combustion catalyst added. It is to be seen from FIG. 4 that a slight improvement in $NO_x$ reduction was obtained when operating with three stages.

Figure 4:
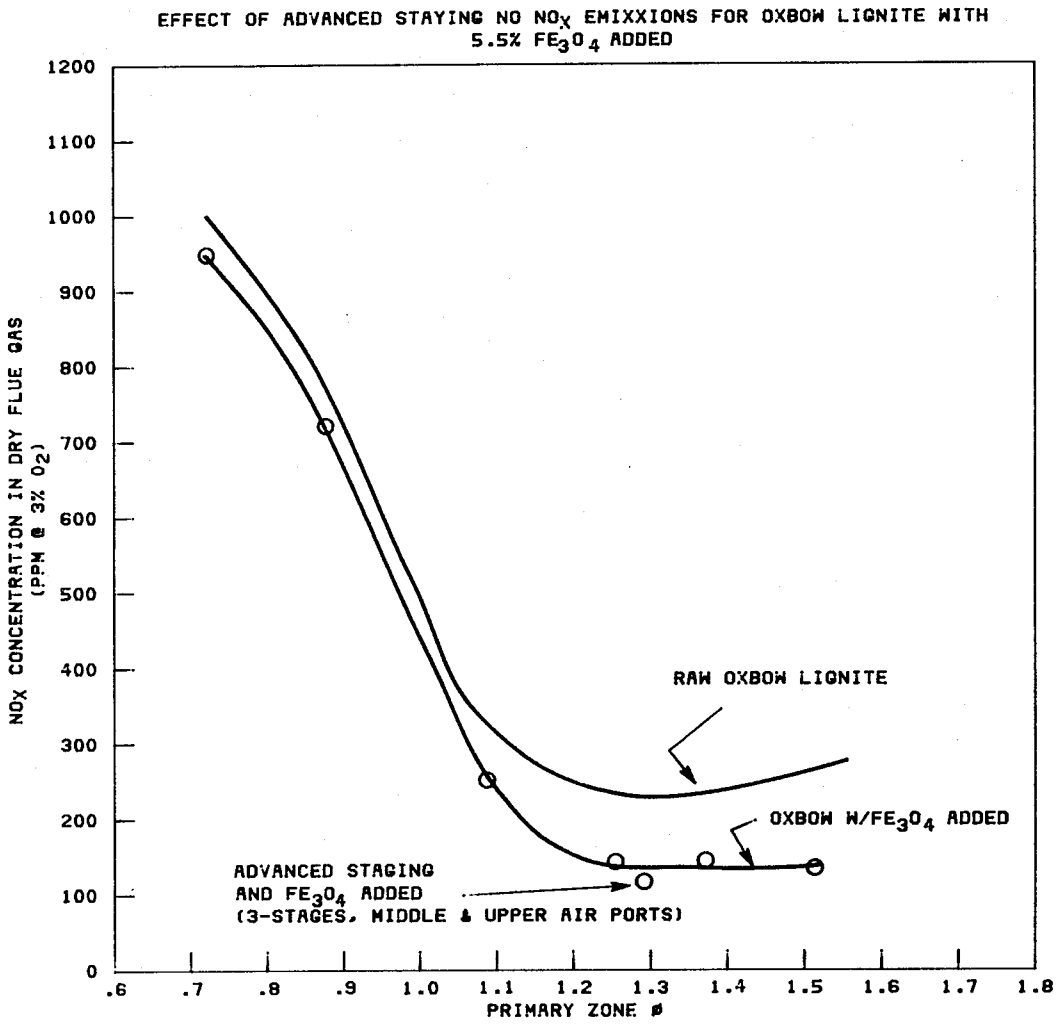
FIGS. 4–7 are plots similar to that of FIG. 3 showing the results obtained in three-stage combustion.
Figure 5:
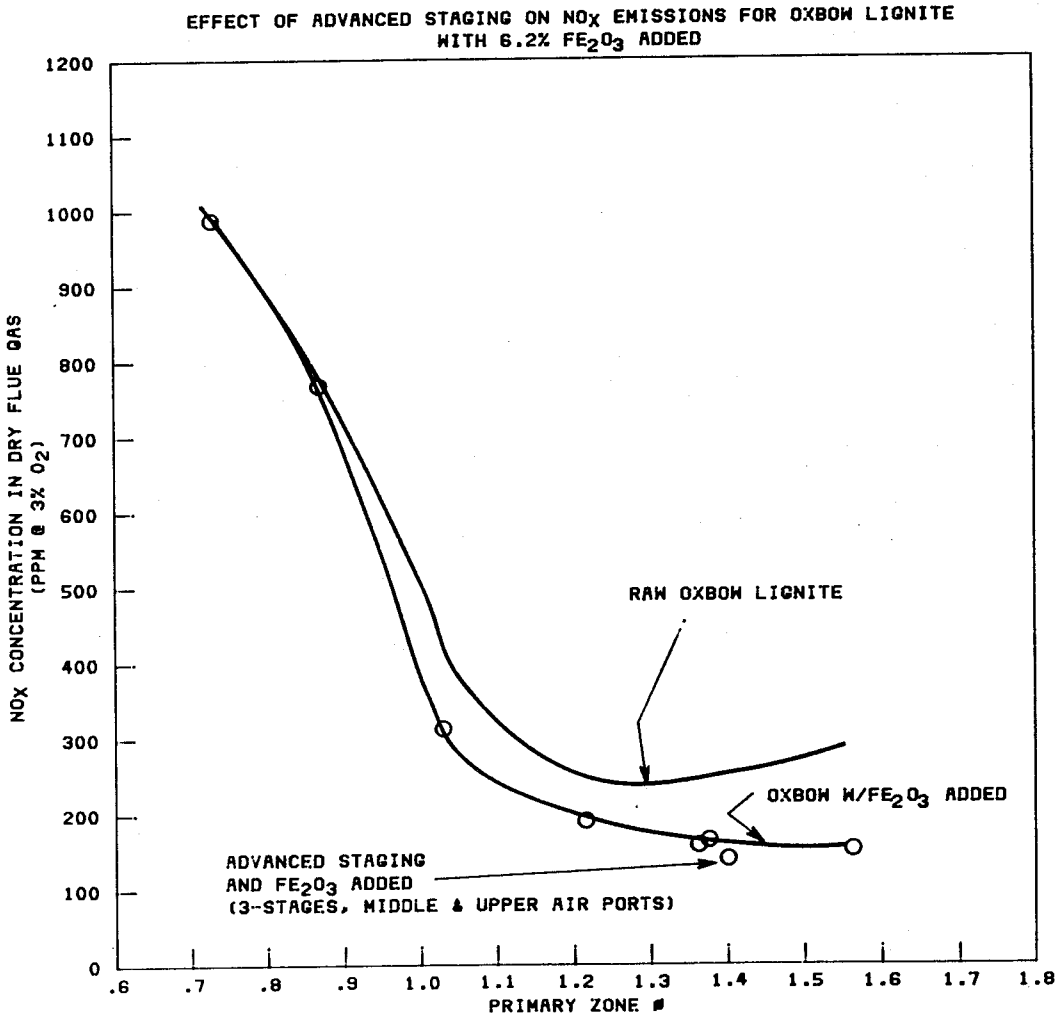

Another series of runs was conducted similar to that shown in FIG. 4, except that a larger amount, namely, 6.2% of the combustion catalyst was added. These results are shown in FIG. 5.

In yet another series of tests, a three-stage process was carried out, utilizing air ports 34 and 36 of FIG. 1, and compared with a two-stage combustion process. Again, it is to be observed, in FIG. 6, that a slight improvement in $NO_x$ reduction was obtained.

Figure 6:
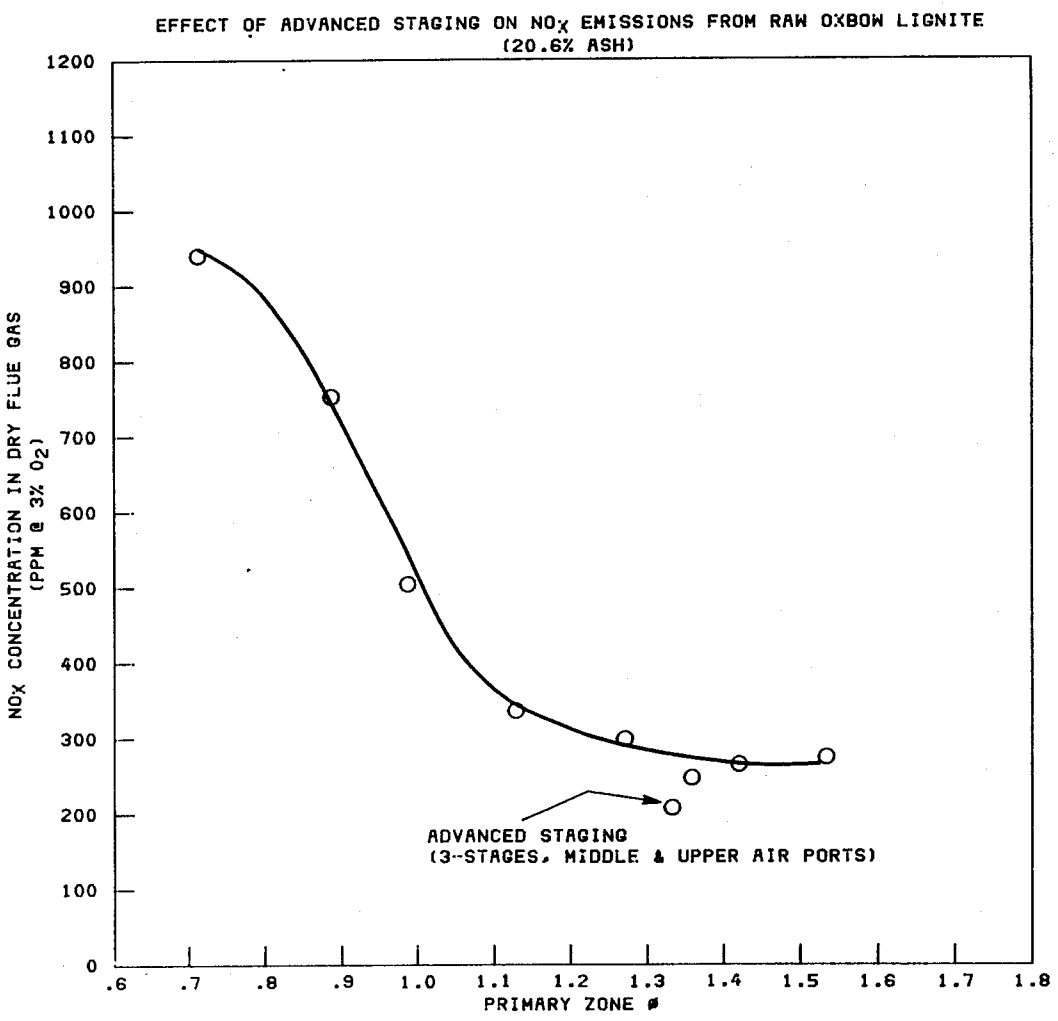
Figure 7:
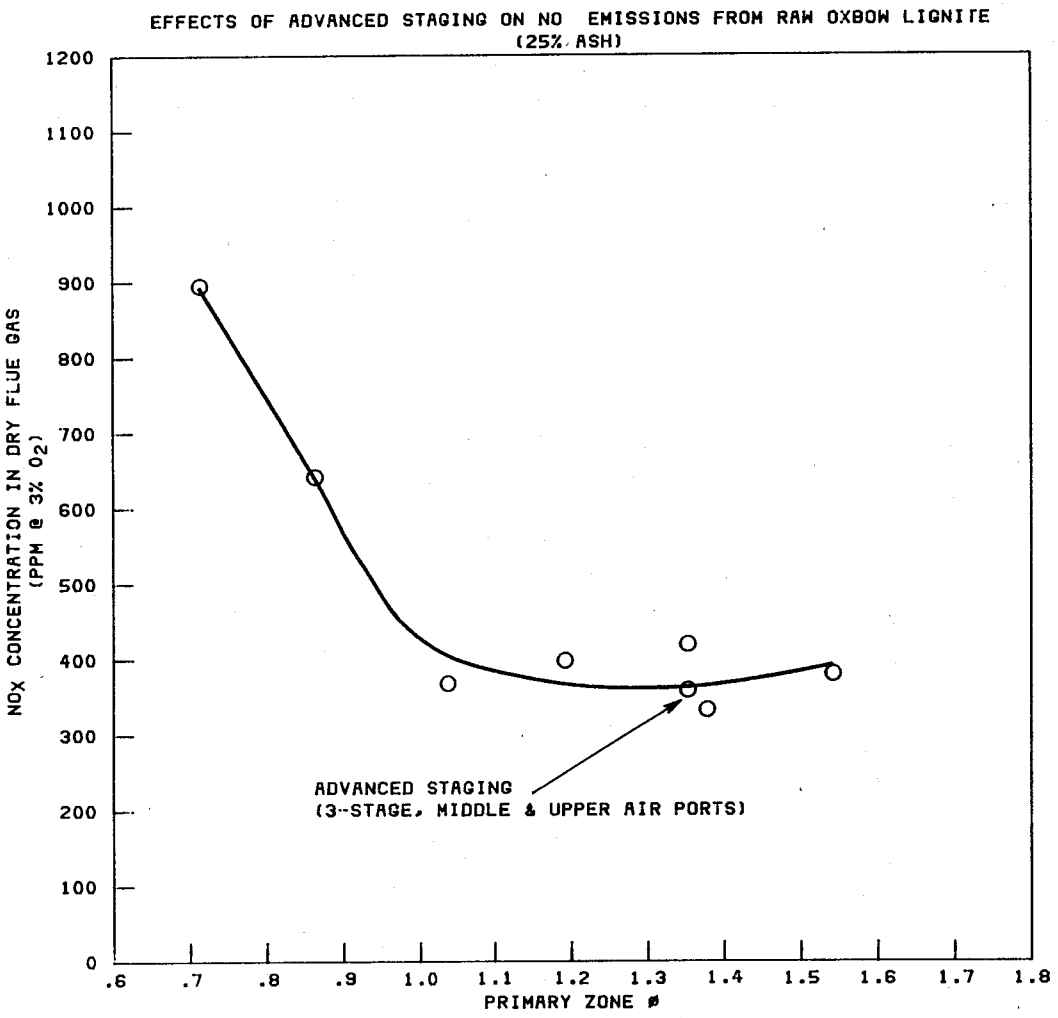

The runs illustrated in FIG. 6 were repeated with a lignite containing about 25% ash. In this case it is to be observed in FIG. 7, that little or no improvement over two-stage operation was obtained.

Figure 8:
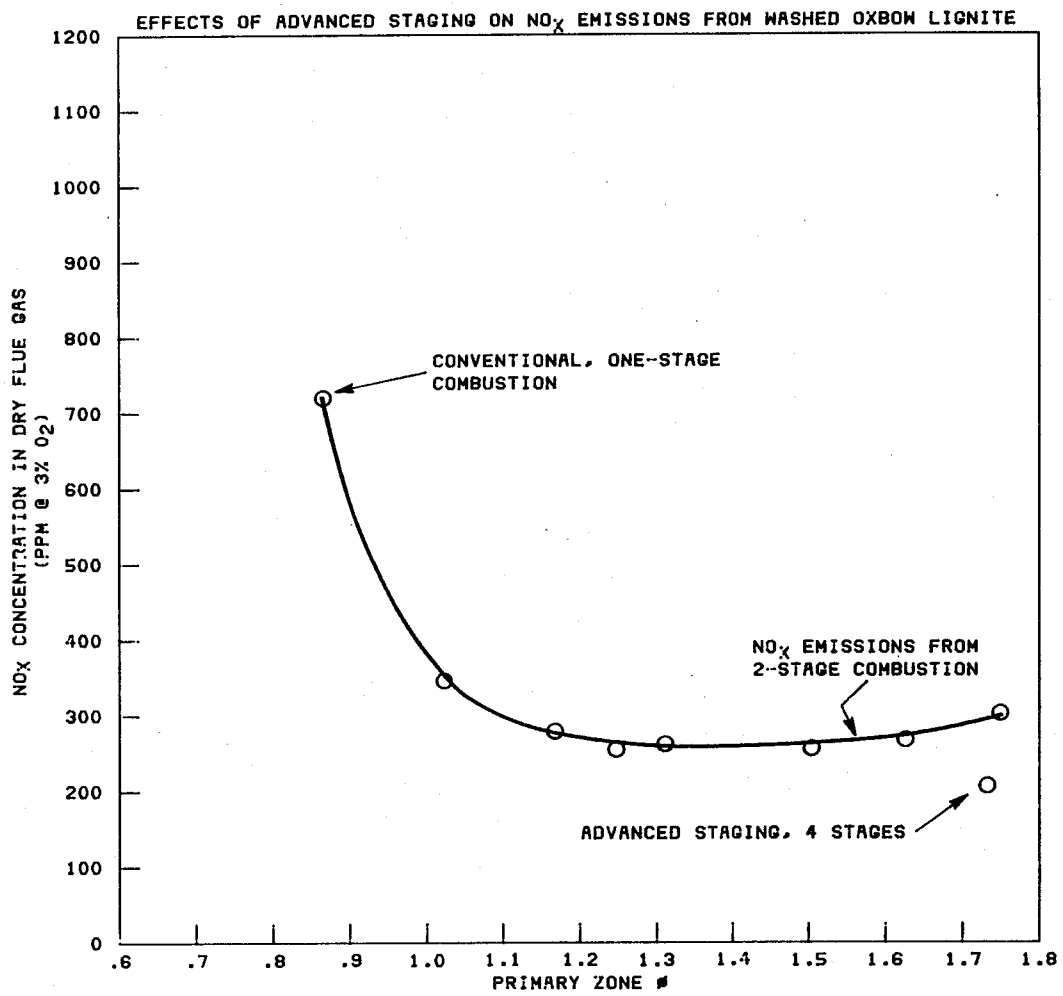
FIG. 8 is a plot similar to that of FIG. 3 showing the results obtained by four-stage combustion.

Finally, a series of runs was conducted in which four-stage combustion comprising; three fuel-rich stages and a fuel-lean stage and introducing air into all three ports, 32, 34, and 36 of FIG. 1 and was compared with the results obtained in the operation of a single stage combustor and a two-stage combustor. These results are shown in FIG. 8 and it is to be noted that a substantial improvement in $NO_x$ reduction was obtained in the four-stage combustion operation.

As previously pointed out in the introductory portion hereof, little removal of sulfur occurs in a single stage combustion process. However, it has been found in accordance with the present invention, that if a sulfur scavenger, such as, limestone is added to the fuel and the fuel is burned in the multiple stage combustion operation, comprising, at least four stages, substantial reductions in $SO_x$ pollutants can be attained.

While it is not intended to be held to any particular theory, it is believed that staged combustion in the presence of sulfur scavenger appears to spread out the heat release of the combustion process and produce lower temperatures in the flame with enhanced stability of the scavenger. In addition, it is believed that the reducing atmosphere of the primary zone induces the formation of calcium sulfide which may either survive throughout combustion or be converted to calcium sulfate in the last stage. Therefore, both $NO_x$ and $SO_x$ pollutants can be reduced in accordance with the present invention by adding a sulfur scavenger to the fuel and burning the fuel in at least four stages, namely, three fuel-rich stages followed by a fuel-lean stage.

While specific materials, equipment and techniques are referred to herein, it is to be understood that these specific recitals are for illustration and to set forth the best mode of operation and are not to be considered limiting.

That which is claimed:

1. A method of burning a fuel, containing significant amounts of $NO_x$ precursors, comprising:

(a) passing said fuel through at least four serially connected combustion zones in open communication with one another, including, at least three fuel-rich zones and a last fuel-lean zone;

(b) adding a first volume of combustion-supporting material adjacent the upstream end of the first of said fuel-rich zones and intimately mixing the thus added first volume of combustion-supporting material with all of said fuel adjacent said upstream end of said first of said fuel-rich zones;

(c) adding an additional volume of combustion-supporting material adjacent the upstream end of each of the remaining fuel-rich zones and intimately mixing the thus added additional volume of combustion-supporting material with effluent from the immediately preceeding fuel-rich zone adjacent said upstream end of each of said remaining fuel-rich zones;

(d) the total combustion-supporting material thus added to the upstream ends of said first fuel-rich zone and said remaining fuel-rich zones, together with said fuel, resulting in a fuel/combustion-supporting material equivalence ratio greater than 1.0;

(e) adding a still further volume of combustion-supporting material adjacent the upstream end of said fuel-lean zone and intimately mixing the thus added still further volume of combustion-supporting material with effluent from the last of said fuel-rich zones adjacent said upstream end of said fuel-lean zone;

(f) the total combustion-supporting material thus added to the upstream ends of said first fuel-rich zone, said remaining fuel-rich zones and said fuel-lean zone, together with said fuel, resulting in a fuel/combustion-supporting material equivalence ratio less than 1.0;

(g) providing an outlet from each combustion zone of substantially less cross-sectional area than the cross-sectional area of the beginning of the next succeeding combustion zone and abruptly terminating more fuel-rich combustion adjacent the downstream end of each of a preceeding one of said combustion zones and initiating less fuel-rich combustion adjacent the upstream end of each of an immediately succeeding one of said combustion zones, at least in part, by thus adding combustion-supporting material to the effluent of said preceeding one of said combustion zones as a plurality of radial jets toward the center of said combustion zone, whereby at least four clearly defined combustion zones are formed; and (h) burning said fuel in the presence of said combustion-supporting material in a serial manner in said at least four combustion zones.

2. A method in accordance with claim 1 wherein abrupt termination of more fuel-rich combustion adjacent the downstream end of each preceding combustion zone is attained by abruptly expanding the effluent from the downstream end of said each preceding combustion zone into the upstream end of each immediately succeeding combustion zone and adding the combustion-supporting material to the effluent from said each preceding combustion zone immediately adjacent the location of such abrupt expansion.

3. A method in accordance with claim 1 wherein abrupt termination of more fuel-rich combustion adjacent the downstream end of each preceding combustion zone is attained by reducing the peripheral dimension of the effluent from the downstream end of said each preceding combustion zone, immediately thereafter abruptly expanding the effluent of reduced peripheral dimension from said downstream end of said each preceding combustion zone into the upstream end of each immediately succeeding combustion zone and adding the combustion-supporting material to the effluent from said each preceding combustion zone immediately adjacent the location of such abrupt expansion.

4. A method in accordance with claim 2 or 3 wherein the combustion-supporting material is added immediately preceding the abrupt expansion of the effluent.

5. A method in accordance with claim 3 wherein the combustion-supporting material is introduced into the reduced peripheral dimension portion of the effluent.

6. A method in accordance with claims 1, 2, 3, 4, or 5 wherein a sulfur scavenger is added to the fuel and first volume of air adjacent the upstream end of the first fuel-rich zone.

7. A method in accordance with claim 6 wherein the sulfur scavenger is a compound selected from the group consisting of metal carbonates, metal oxides and mixtures thereof.

8. A method in accordance with claim 6 wherein the sulfur scavenger is a calcium compound selected from the group consisting of $Ca(OH)_2$, $CaCO_3$, $CaMg(CO_3)_2$ and mixtures thereof.

9. A method in accordance with claim 6 wherein the sulfur scavenger is a metal carbonate.

10. A method in accordance with claim 6 wherein the sulfur scavenger is selected from the group consisting of $CaCO_3$, $CaMg(CO_3)_2$, $MgCO_3$ and mixtures thereof.

11. A method in accordance with claim 6 wherein the sulfur scavenger is a metal compound and is present in an amount sufficient to provide a metal/sulfur ratio near the stoichiometric ratio.

* * * * *